US006402587B1

(12) United States Patent
Nopwaskey et al.

(10) Patent No.: US 6,402,587 B1
(45) Date of Patent: Jun. 11, 2002

(54) FLOOR MOUNTED ULTRA HIGH PRESSURE ABRASIVE CUTTING APPARATUS

(75) Inventors: Fred Charles Nopwaskey, San Jose; Hsueh-Wen Pao, Saratoga; Gary Allen Boortz, San Jose, all of CA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/471,051

(22) Filed: Dec. 22, 1999

(51) Int. Cl.[7] ..... B24C 3/32
(52) U.S. Cl. ..... 451/2; 451/76; 451/92
(58) Field of Search ..... 451/92, 75, 76, 451/88, 38, 2, 40

(56) References Cited

U.S. PATENT DOCUMENTS

| | | | | |
|---|---|---|---|---|
| 2,985,050 A | | 5/1961 | Schwacha | |
| 4,686,877 A | * | 8/1987 | Jaritz et al. | 83/177 |
| 5,001,870 A | * | 3/1991 | Yokota et al. | 451/75 |
| 5,065,551 A | | 11/1991 | Fraser | |
| 5,295,425 A | | 3/1994 | Hediger | |
| 5,503,591 A | * | 4/1996 | Morikawa et al. | 451/75 |
| 5,704,824 A | | 1/1998 | Hashish et al. | |
| 5,778,713 A | | 7/1998 | Butler et al. | |
| 6,049,580 A | * | 4/2000 | Bodin et al. | 376/316 |

* cited by examiner

*Primary Examiner*—Robert A. Rose
(74) *Attorney, Agent, or Firm*—Armstrong Teasdale LLP

(57) ABSTRACT

An ultra high pressure abrasive waterjet cutting apparatus for underwater cutting of structural components of a nuclear reactor is described. The cutting apparatus includes a multi-axis manipulator, an ultra high pressure abrasive waterjet (UHP) cutting nozzle coupled to the manipulator, a collection stand assembly, a collection hood movably coupled to the collection stand assembly, and a turntable having a non-movable center portion. The multi-axis manipulator is configured to mount on the non-movable center portion of the turntable or on the floor of the pool of water in which the structural component is positioned for cutting. The collection stand assembly is configured to mount on at least one of the floor and the wall of the pool of water. The cutting nozzle and collection hood are positioned on opposite sides of the structural component to be cut.

21 Claims, 5 Drawing Sheets

FLOOR MOUNTED ULTRA HIGH PRESSURE ABRASIVE CUTTING APPARATUS

BACKGROUND OF THE INVENTION

This invention relates generally to cutting apparatus and more particularly to ultra high pressure abrasive waterjet cutting apparatus for cutting nuclear reactor structural components.

Structural components within nuclear reactor pressure vessels (RPV) become irradiated, and those components nearest the reactor core become highly irradiated. When such structural components require removal from the RPV and replacement, the components must be unbolted or cut from their original position and then subsequently cut into smaller sections for shipping and final storage. Because these components are radioactive, they must remain underwater to provide radiation shielding to workers in the proximity of the reactor components. The cutting process used to cut these structural components into smaller sections must therefore be performed underwater.

Known cutting apparatus for cutting reactor internals typically include a gantry type bridge with a partially submersible mast/manipulator attached. The gantry bridge and submersible manipulator permits from three to five axis of motion for the cutting nozzle. The disadvantages of these known cutting apparatus are that the gantry type bridge needs to be mounted on existing rails in the reactor, or new rails have to be installed. Because the cutting apparatus is mounted above the reactor internal components, it interferes with overhead crane cables when the crane is used for handling cut pieces of the reactor internal components. Additionally, the cutting apparatus interferes with the service platform which is used by personnel over the cutting area for manipulating rigging and cameras. Additionally, there is a possibility of the gantry running over hoses and power cables. It is also known that the mast/manipulator has stability problems when used with an ultra high pressure waterjet nozzle because of the force applied by the reaction to the ultra high pressure waterjet.

It would be desirable to provide a cutting apparatus for cutting reactor internal component parts in a nuclear reactor that does not include a gantry type bridge mounted on rails above the reactor.

BRIEF SUMMARY OF THE INVENTION

In an exemplary embodiment, an ultra high pressure abrasive waterjet cutting apparatus for underwater cutting of structural components of a nuclear reactor includes a multi-axis manipulator, an ultra high pressure abrasive water jet (UHP) cutting nozzle coupled to the manipulator, a collection stand assembly, and a collection hood movably coupled to the collection stand assembly. The multi-axis manipulator is configured to mount on the floor of the pool of water in which the structural component is positioned for cutting.

The multi-axis manipulator includes a base actuator configured to mount on the pool floor, a vertical actuator movably coupled to the base actuator. The vertical actuator extends substantially perpendicular to the base actuator and is movable along the longitudinal axis of the base actuator. A horizontal actuator is movably coupled to the vertical actuator. The horizontal actuator extends substantially perpendicular to the vertical actuator and is movable along the longitudinal axis of the vertical actuator. The horizontal actuator is also movable along the longitudinal axis of the horizontal actuator. A rotating manipulator is coupled to one end of the horizontal actuator, and the UHP cutting nozzle is coupled to the rotating manipulator. The UHP cutting nozzle is movable in an arc around the end of the horizontal actuator.

The collection stand assembly includes a vertical support stand configured to mount on the pool floor or the pool wall. A support frame is movably coupled to the support stand with the support frame movable along the longitudinal axis of the support stand. At least one positioning cylinder is coupled at one end to the support frame and at an opposite end to the collection hood.

The UHP cutting apparatus can further include a turntable configured to support the component to be cut and to move the component in relation to the UHP cutting nozzle and the collection hood. The turntable includes a non-movable center portion and a movable outer portion. The multi-axis manipulator is mounted on the non-movable center portion of the turntable.

To cut a structural component of a nuclear reactor, for example a shroud, utilizing the ultra high pressure abrasive waterjet cutting apparatus described above, the cutting apparatus and shroud are positioned in a pool of water, for example the reactor containment pool. Particularly the multi-axis manipulator is mounted on the floor of the pool on one side of the shroud, for example the interior of the shroud, and the collection stand assembly is mounted in the pool on the opposite side of the shroud, for example, the outside of the shroud, and in alignment with the cutting nozzle coupled to the manipulator.

The collection stand assembly support frame is moved along the vertical support stand to position the collection hood in alignment with the desired cutting area. The collection hood positioning cylinders are activated to position the collection hood adjacent the outer surface of the shroud.

The base and vertical actuators are activated to position the cutting nozzle at the starting point of the cut. The horizontal actuator is actuated to position the cutting nozzle adjacent the inner surface of the shroud. To make a horizontal cut, the cutting nozzle is actuated and the base actuator moves the vertical actuator, and thus the cutting nozzle, in a horizontal direction. The abrasive containing UHP water jet cuts through the shroud and enters the collection hood positioned on the opposite side of the shroud The water filtration system connected to the collection chamber outlet port filters the used abrasive and kerf material from the water before it is returned to the reactor To make a vertical cut the vertical actuator moves the horizontal actuator, and thus the cutting nozzle in a vertical direction. To cut parts that extend from the inner surface of the shroud, the rotating manipulator moves the cutting nozzle in an arc.

The above described ultra high pressure abrasive waterjet cutting apparatus is supported by the floor of the pool, thus eliminating the need for a gantry type bridge and partially submersed mast/manipulator. The above described cutting apparatus does not interfere with overhead crane cables when the crane is used for handling cut pieces of the reactor internal components, or interfere with the service platform which is used by personnel over the cutting area for manipulating rigging and cameras.

DETAILED DESCRIPTION OF THE INVENTION

Figure 1:
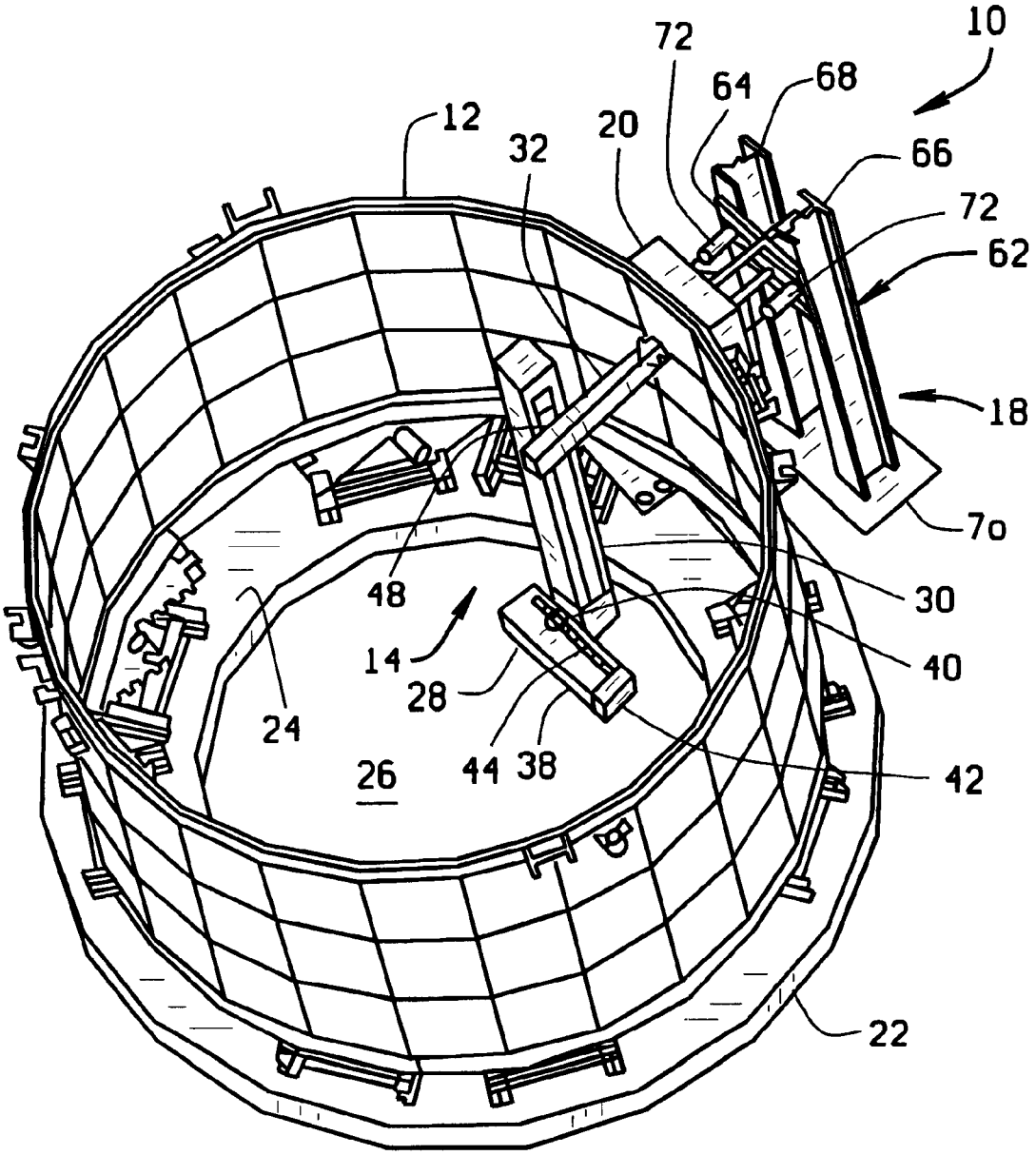
FIG. 1 is a perspective view of a floor mounted ultra high pressure abrasive cutting apparatus in accordance with one embodiment of the present invention positioned adjacent a reactor shroud.
Figure 2:
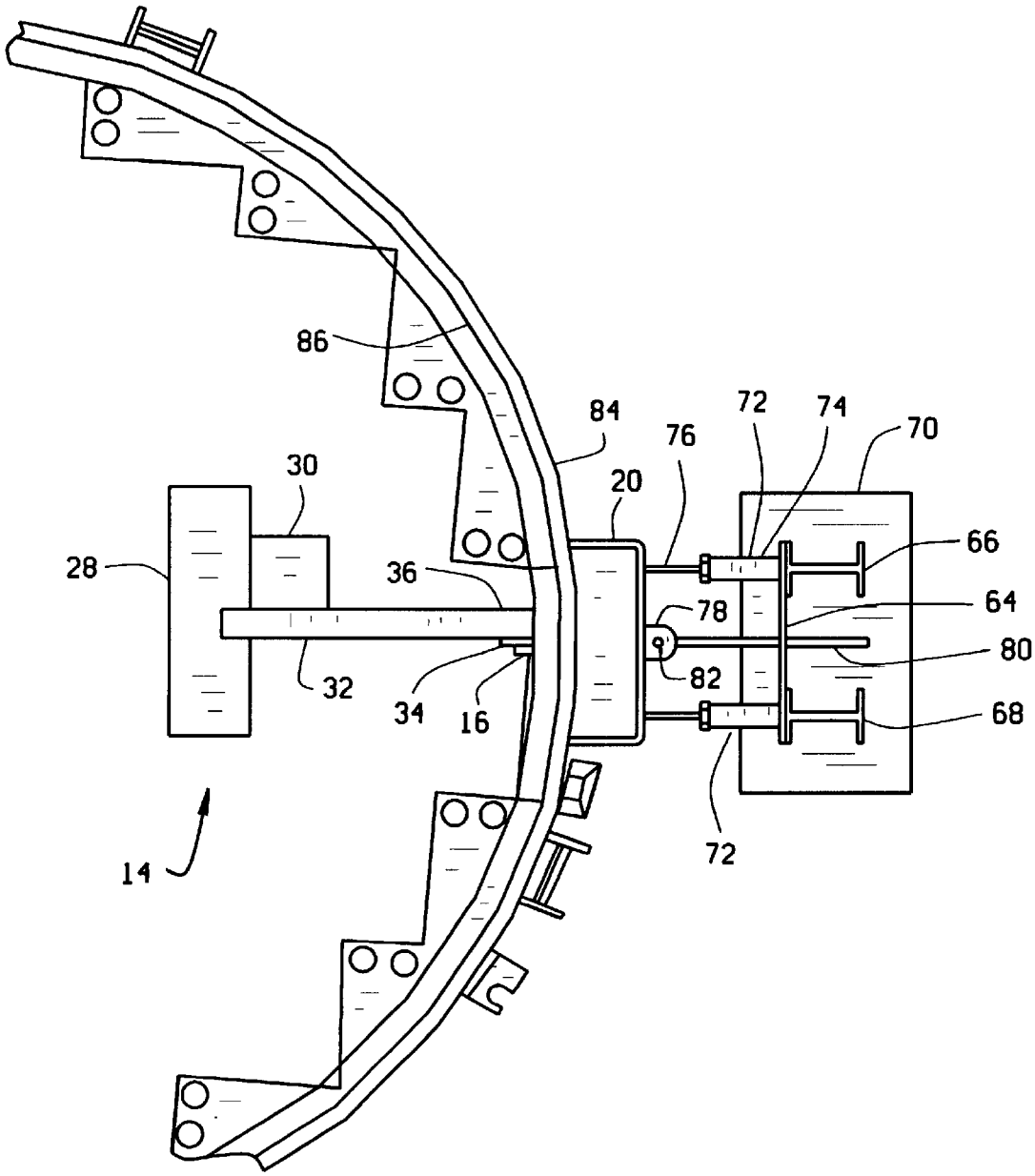
FIG. 2 is top view of the cutting apparatus shown in FIG. 1.
Figure 3:
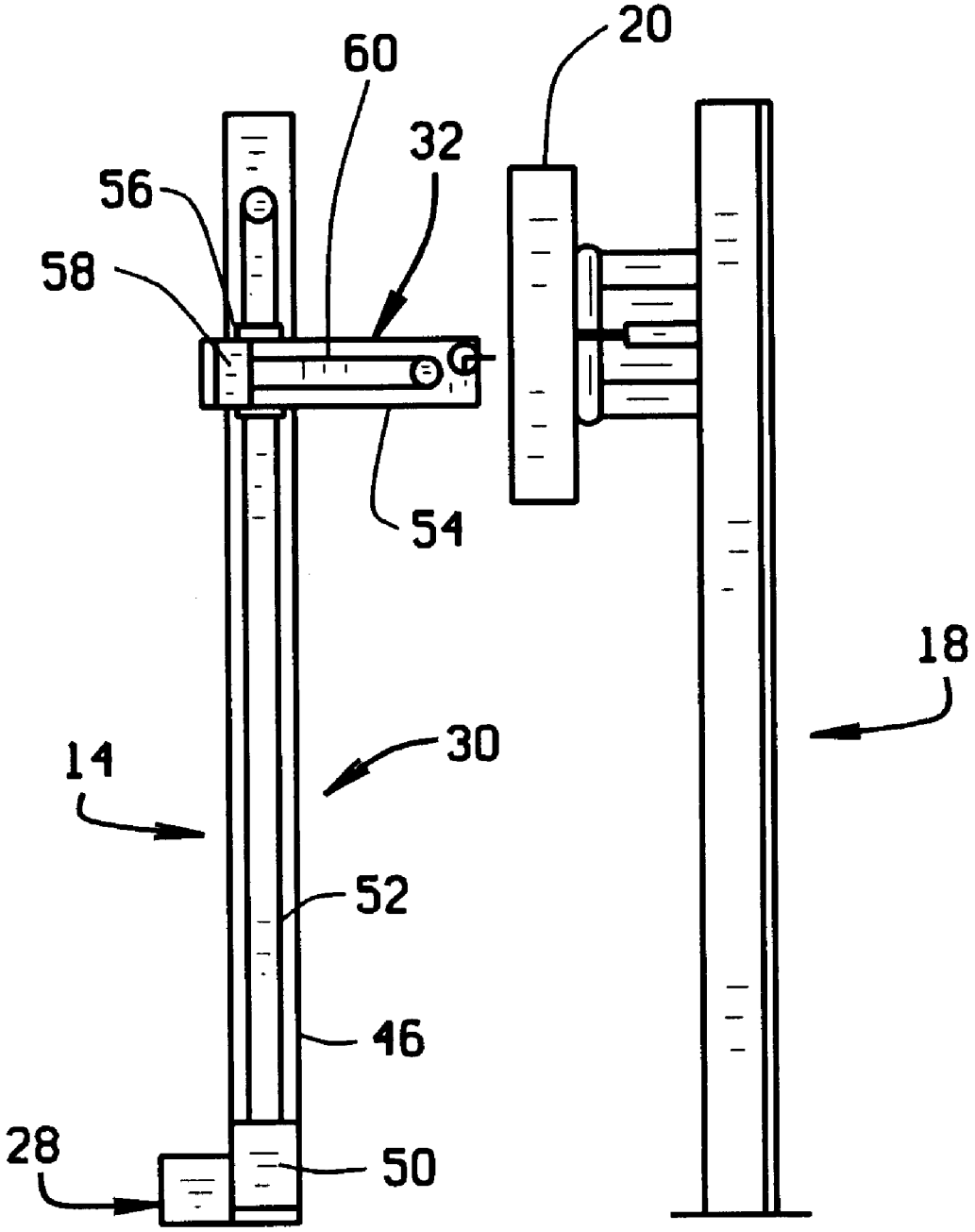
FIG. 3 is a side view of the cutting apparatus shown in FIG. 1.

FIG. 1 is a perspective view of a floor mounted ultra high pressure abrasive cutting apparatus 10 in accordance with an exemplary embodiment of the present invention positioned adjacent a reactor shroud 12. FIG. 2 is top view of cutting apparatus 10, and FIG. 3 is a side view of cutting apparatus 10. Referring to FIGS. 1, 2, and 3, cutting apparatus 10 includes a multi-axis manipulator 14, an ultra high pressure abrasive waterjet (UHP) cutting nozzle 16 coupled to manipulator 14, a collection stand assembly 18, and a collection hood 20 movably coupled to collection stand assembly 18. Cutting apparatus 10 also includes turntable 22 having a movable portion 24 and a non-movable center portion 26. Multi-axis manipulator 14 is mounted on non-movable center portion 26. In an alternative embodiment, where apparatus 10 does not include a turntable 22, manipulator 14 is mounted on the floor of the pool of water in which shroud 12 is positioned for cutting. Typically shroud 12 is positioned in the reactor containment pool, but any pool of water large enough to hold shroud 12 may be used.

Multi-axis manipulator 14 includes a base actuator 28 configured to mount on non-movable center portion 26 of turntable 22, or the pool floor. A vertical actuator 30 is movably coupled to base actuator 28. Vertical actuator 30 extends substantially perpendicular to base actuator 28 and is movable along the longitudinal axis of base actuator 28. A horizontal actuator 32 is movably coupled to vertical actuator 30. Horizontal actuator 32 extends substantially perpendicular to vertical actuator 30 and is movable along the longitudinal axis of vertical actuator 30. Horizontal actuator 32 is also movable along its own longitudinal axis.

A rotating manipulator 34 is coupled to a first end 36 of horizontal actuator 32. UHP cutting nozzle 16 is coupled to rotating manipulator 34. UHP cutting nozzle 16 is movable in a 180 degree arc around end 36 of horizontal actuator 32. Ultra high pressure abrasive waterjet cutting typically uses ultra high pressure water of about 40,000 to 80,000 pounds per square inch (2800 to 5600 $Kg/cm^2$) supplied to cutting nozzle 16. Additionally, abrasive material is added to the ultra high pressure water at cutting nozzle 42 at a rate of about 0.05 to 3.0 pounds per minute (22 to 1350 grams/min). A stream of ultra high pressure water including abrasive particles is expelled from cutting nozzle 16 and directed toward the surface of shroud 12. The impingement of the ultra high pressure water and the abrasive particles cuts through the metal. Cutting nozzle 16 is moved relative to the surface of 16 by multi-axis manipulator 14.

Base actuator 28 includes a linear frame 38 and a support plate 40 movably coupled to linear frame 38. Support plate 40 is movable along linear frame 38, and vertical actuator 30 is coupled to base actuator support plate 40. Base actuator 28 further includes a motor 42 coupled to base actuator linear frame 38 and operatively coupled to base actuator support plate 40. Base actuator motor 42 is operatively coupled to base actuator support plate 40 by a ball screw 44. In an alternate embodiment, a drive belt operatively couples base actuator motor 42 to base actuator support plate 40.

Vertical actuator 30 includes a linear frame 46 and a support plate 48 movably coupled to vertical actuator linear frame 46. Vertical actuator support plate 48 is movable along vertical actuator linear frame 46, and horizontal actuator 32 is coupled to vertical actuator support plate 48. Vertical actuator 30 further includes a motor 50 coupled to vertical actuator linear frame 46 and operatively coupled to vertical actuator support plate 48. Vertical actuator motor 50 is operatively coupled to vertical actuator support plate 48 by a drive belt 52. In an alternate embodiment, a ball screw operatively couples vertical actuator motor 50 to base actuator support plate 48.

Horizontal actuator 32 comprises a linear frame 54 and a support plate 56 movably coupled to horizontal actuator linear frame 54. Horizontal actuator linear frame 54 is movable along the longitudinal axis of horizontal actuator 32 in relation to horizontal actuator support plate 56. Horizontal actuator support plate 56 is coupled to vertical actuator support plate 48. Horizontal actuator 32 further includes a motor 58 coupled to horizontal actuator linear frame 54 and operatively coupled to horizontal actuator support plate 56. Horizontal actuator motor 58 is operatively coupled to horizontal actuator support plate 56 by a drive belt 60. In an alternate embodiment, a ball screw operatively couples horizontal actuator motor 58 to horizontal actuator support plate 56.

Collection stand assembly 18 includes a vertical support stand 62 configured to mount on the pool floor. A support frame 64 is movably coupled to support stand 62 with support frame 64 movable along the longitudinal axis of support stand 62. Support stand 62 includes beams 66 and 68 extending from base plate 70. Support frame 64 is movably coupled to beams 66 and 68. Positioning cylinders 72 are coupled at a first end 74 to support frame 64 and at a second end 76 to collection hood 20.

Collection hood 20 includes a pivot engagement portion 78 for a pivotable attachment to support frame 64. A pivot extension arm 80 slidably extends from support frame 64. Pivot engagement portion 78 is coupled to pivot extension arm 80 by pivot pin 82. Collection hood 20 is pivotable about pivot pin 82.

To cut shroud 12 utilizing ultra high pressure abrasive waterjet cutting apparatus 40, shroud 12 and cutting apparatus 40 are positioned in a pool of water, for example the reactor containment pool. Particularly, turntable 22 is positioned on the floor of the reactor containment pool and shroud 12 is positioned on movable portion 24 of turntable 22. Multi-axis manipulator is mounted on non-movable center portion 26 of turntable 22 on the inside of shroud 22, and collection stand assembly 18 is mounted in the pool outside of shroud 12, and in alignment with cutting nozzle 16 coupled to. manipulator 14.

Collection stand assembly support frame 64 is moved along vertical support stand 62 to position collection hood 20 in alignment with the desired cutting area. Collection hood positioning cylinders 72 are activated to position collection hood 20 adjacent an outer surface 84 of shroud 12.

Base and vertical actuators 28 and 30 are activated to position cutting nozzle 16 at the starting point of the cut. Horizontal actuator 32 is actuated to position cutting nozzle 16 adjacent an inner surface 86 of shroud 12. To make a horizontal cut, cutting nozzle 16 is actuated and base actuator 28 moves vertical actuator 30, and thus cutting nozzle 16, in a horizontal direction. The abrasive containing UHP water jet cuts through shroud 12 and enters collection hood 12 positioned on the opposite side of shroud 12. The water filtration system (not shown), connected to an outlet of collection chamber 20, filters the used abrasive and kerf material from the water before it is returned to the reactor pool. To make a vertical cut vertical actuator 30 moves horizontal actuator 32, and thus cutting nozzle 16 in a vertical direction. To cut parts that extend from inner surface 86 of shroud 12, rotating manipulator 34 moves cutting nozzle 16 in an arc.

Figure 4:
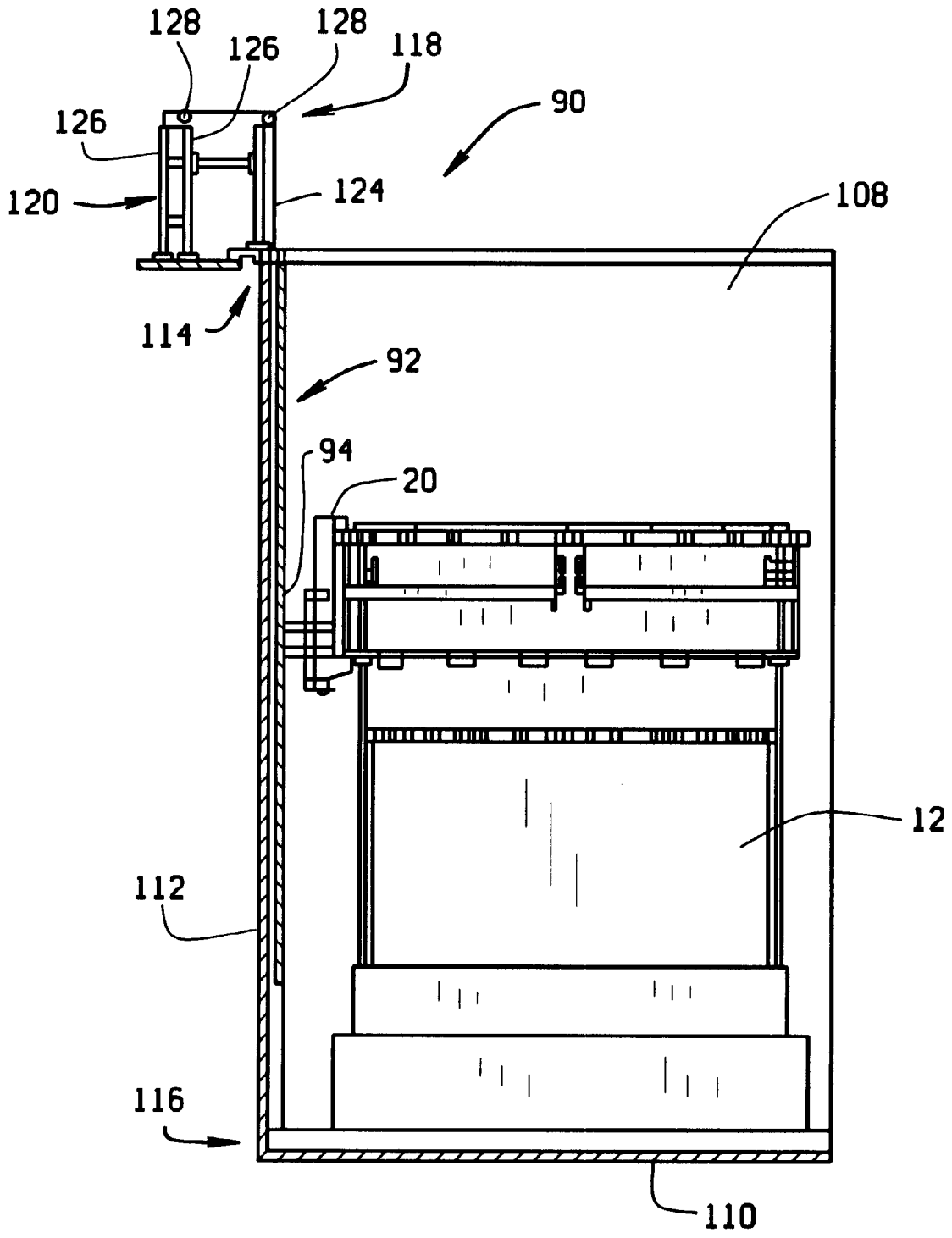
FIG. 4 is side view of the collection stand assembly and collection hood of a floor mounted ultra high pressure abrasive cutting apparatus in accordance with another embodiment of the present invention.
Figure 5:
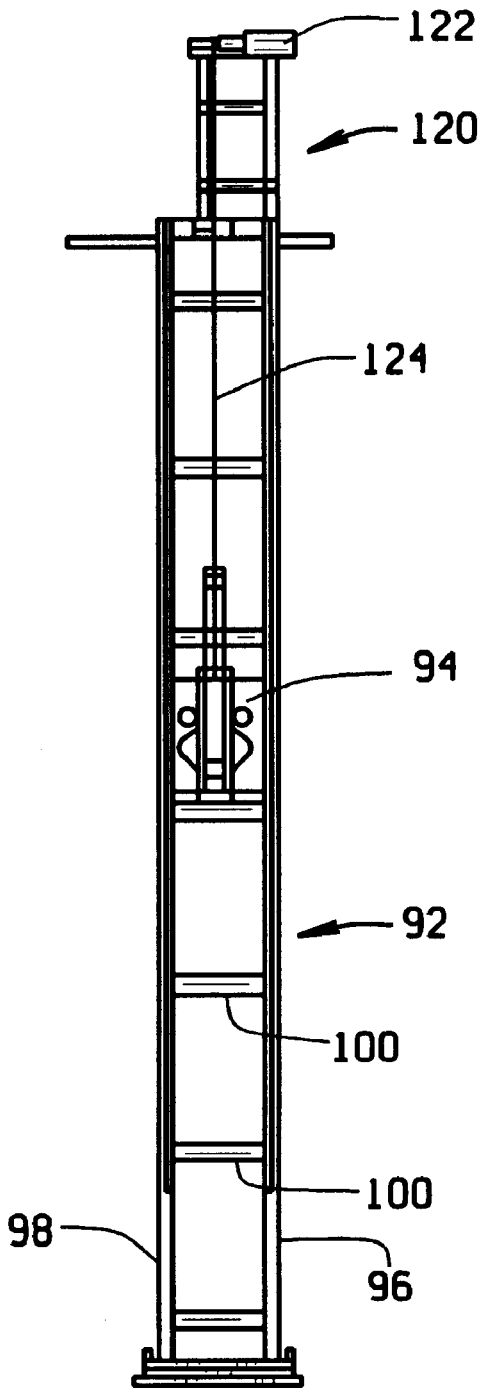
FIG. 5 is a front view of the collection stand assembly shown in FIG. 4.

FIG. 4 is side view of a collection stand assembly 90 in accordance with another exemplary embodiment of the present invention. FIG. 5 is a front view of collection stand assembly 90. Referring to FIGS. 4 and 5, collection stand assembly 90, like collection stand assembly 18 described above, includes a vertical support stand 92 and a support frame 94 movably coupled to support stand 92. Support frame 94 is movable along the longitudinal axis of support stand 92. Support stand 92 includes beams 96 and 98 spaced apart and connected together by a plurality of cross beams 100 extending between beams 96 and 98. Support frame 94 is movably coupled to beams 96 and 98. Positioning cylinders 102 are coupled at a first end 104 to support frame 94 and at a second end 106 to collection hood 20.

FIG. 4 shows collection stand assembly 90 and shroud 12 positioned in a cylindrical pool 108 bounded by a floor 110 and a wall 112. Beams 96 and 98 engage the top 114 and bottom 116 of wall 112 to support collection stand assembly 90.

Collection stand assembly 90 also includes a drive subassembly 118 for moving support frame 94 along support stand 92. Drive subassembly 118 includes a drive support structure 120, a motor 122 coupled to drive support structure 120, and a drive cable 124 extending between and operatively coupled to motor 122 and support frame 94. Drive subassembly 118 includes a plurality of beams 126 mounted above pool wall 112. Motor 122 is coupled to beam 126. Subassembly 118 also includes a plurality of cable guide pulleys 128.

The above described ultra high pressure abrasive waterjet cutting apparatus 10 is supported by the floor of the pool, thus eliminating the need for a gantry type bridge and partially submersed mast/manipulator. The above described cutting apparatus 10 does not interfere with overhead crane cables when the crane is used for handling cut pieces of the reactor internal components, or interfere with the service platform which is used by personnel over the cutting area for manipulating rigging and cameras.

While the invention has been described and illustrated in terms of various specific embodiments, those skilled in the art will recognize that the invention can be practiced with modification within the spirit and scope of the claims.

What is claimed is:

1. A cutting apparatus for underwater cutting of structural components of nuclear reactor, the structural component located in a pool of water having a floor and side walls, said cutting apparatus comprising:

a multi-axis manipulator configured to mount on the pool floor;

an ultra high pressure abrasive waterjet cutting nozzle coupled to said manipulator;

a collection stand assembly; and a collection hood movably coupled to said collection stand assembly.

2. A cutting apparatus in accordance with claim 1 wherein said multi-axis manipulator comprises a four axis manipulator.

3. A cutting apparatus in accordance with claim 2 wherein said manipulator comprises:

a base actuator configured to mount on the pool floor;

a vertical actuator movably coupled to said base actuator, said vertical actuator extending substantially perpendicular to said base actuator and movable along the longitudinal axis of said base actuator;

a horizontal actuator movably coupled to said vertical actuator, said horizontal actuator extending substantially perpendicular to said vertical actuator and movable along the longitudinal axis of said vertical actuator, said horizontal actuator also movable along the longitudinal axis of said horizontal actuator; and a rotating manipulator coupled to a first end of said horizontal actuator, said cutting nozzle coupled to said rotating manipulator, said cutting nozzle movable in an arc around said first end of said horizontal actuator.

4. A cutting apparatus in accordance with claim 1 wherein said collection stand assembly comprises:

a support stand configured to mount on at least one of the pool floor and the pool wall;

a support frame movably coupled to said support stand, said support frame movable along the longitudinal axis of said vertical stand; and at least one positioning cylinder coupled at a first end to said support frame and at a second end to said collection hood.

5. A cutting apparatus in accordance with claim 4 wherein said collection stand assembly further comprises a pivot pin coupled to said support frame, said collection hood pivotably coupled to said pivot pin.

6. A cutting apparatus in accordance with claim 3 wherein said base actuator comprises a linear frame and a support plate movably coupled to said linear frame, said support plate movable along said linear frame, said vertical actuator coupled to said base actuator support plate.

7. A cutting apparatus in accordance with claim 6 wherein said vertical actuator comprises a linear frame and a support plate movably coupled to said vertical actuator linear frame, said vertical actuator support plate movable along said vertical actuator linear frame, said horizontal actuator coupled to said vertical actuator support plate.

8. A cutting apparatus in accordance with claim 7 wherein said horizontal actuator comprises a linear frame and a support plate movably coupled to said horizontal actuator linear frame, said horizontal actuator linear frame movable along the longitudinal axis of said horizontal actuator in relation to said horizontal actuator support plate, said horizontal actuator support plate coupled to said vertical actuator support plate.

9. A cutting apparatus in accordance with claim 6 wherein said base actuator further comprises a motor coupled to said base actuator linear frame and operatively coupled to said base actuator support plate.

10. A cutting apparatus in accordance with claim 9 wherein said base actuator motor is operatively coupled to said base actuator support plate by a drive belt or ball screw.

11. A cutting apparatus in accordance with claim 6 wherein said vertical actuator further comprises a motor coupled to said vertical actuator linear frame and operatively coupled to said vertical actuator support plate.

12. A cutting apparatus in accordance with claim 11 wherein said vertical actuator motor is operatively coupled to said vertical actuator support plate by a drive belt or ball screw.

13. A cutting apparatus in accordance with claim 6 wherein said horizontal actuator further comprises a motor coupled to said horizontal actuator linear frame and operatively coupled to said horizontal actuator support plate.

14. A cutting apparatus in accordance with claim 11 wherein said horizontal actuator motor is operatively coupled to said horizontal actuator support plate by a drive belt or ball screw.

15. A cutting apparatus in accordance with claim 1 wherein said cutting nozzle is in alignment with said collection hood, said cutting apparatus configured so that said cutting nozzle is located on one side of the component to be cut and said collection hood is located on the opposite side of the component to be cut.

16. A cutting apparatus in accordance with claim 15 further comprising a turntable configured to support the component to be cut and to move the component in relation to said cutting nozzle and said collection hood, said turntable comprising a non-movable center portion and a moveable outer portion, said multi-axis manipulator mounted on said non-movable center portion of said turntable.

17. A method of underwater cutting of structural components of a nuclear reactor utilizing an ultra high pressure abrasive waterjet cutting apparatus, the cutting apparatus comprising a multi-axis manipulator, an ultra high pressure abrasive waterjet cutting nozzle coupled to the manipulator, a collector stand, and a collection hood movably coupled to the collector stand, the cutting apparatus configured so that the cutting nozzle is located on one side of the component to be cut and the collection hood is located on the opposite side of the component to be cut and the cutting nozzle is aligned with the collection hood, said method comprising:

positioning the structural component to be cut in a pool of water comprising a floor and at least one side wall;

mounting the multi-axis manipulator on the pool floor;

positioning the cutting apparatus in the pool of water so that the cutting nozzle is positioned on one side of the structural component and the collection hood is positioned on the opposite side of the structural component and aligned with the cutting nozzle; and cutting the structural component with the cutting nozzle.

18. A method in accordance with claim 17 wherein the multi-axis manipulator comprises a base actuator configured to mount on the pool floor, a vertical actuator movably coupled to the base actuator, extending substantially perpendicular to the base actuator and movable along the longitudinal axis of the base actuator, a horizontal actuator movably coupled to the vertical actuator, extending substantially perpendicular to the vertical actuator and movable along the longitudinal axis of the vertical actuator, the horizontal actuator also movable along the longitudinal axis of the horizontal actuator, and a rotating manipulator coupled to a first end of the horizontal actuator, the cutting nozzle coupled to the rotating manipulator, the cutting nozzle movable in an arc around the first end of the horizontal actuator, and cutting the structural component with the cutting nozzle comprises the steps of:

activating the horizontal actuator to position the cutting nozzle adjacent a surface of the structural component;

expelling an ultra high pressure water jet containing abrasive particles from the cutting nozzle; and activating the vertical actuator to move the horizontal actuator along the longitudinal axis of the vertical actuator.

19. A method in accordance with claim 18 wherein cutting the structural component with the cutting nozzle further comprises the step of activating the base actuator to move the vertical actuator along the longitudinal axis of the base actuator.

20. A method in accordance with claim 18 wherein cutting the structural component with the cutting nozzle further comprises the step of activating the rotating manipulator to move the cutting nozzle in an arc.

21. A method in accordance with claim 17 wherein the collector stand comprises a support stand configured to mount on at least one of the pool floor and the poolwall, a support frame movably coupled to the support stand, the support frame movable along the longitudinal axis of the vertical stand, and at least one positioning cylinder coupled at a first end to the support frame and at a second end to the collection hood, and positioning the cutting apparatus in the pool of water further comprises the steps of:

mounting the support stand on at least one of the pool wall and the pool floor;

moving the support frame along the longitudinal axis of the support stand so that the collection hood is in alignment with the cutting nozzle; and activating the at least one positioning cylinders to position the collection hood adjacent an outer surface of the structural component.

* * * * *